US005356041A

United States Patent [19]

Hellenberg et al.

[11] Patent Number: 5,356,041

[45] Date of Patent: Oct. 18, 1994

[54] DISPENSING APPARATUS HAVING IMPROVED VALVING

[75] Inventors: Leendert Hellenberg, Warmond; Mark Voskiul, Leiden, both of Netherlands

[73] Assignee: Fluid Management Limited Partnership, Wheeling, Ill.

[21] Appl. No.: 35,941

[22] Filed: Mar. 23, 1993

[51] Int. Cl.[5] ..... B67D 5/52

[52] U.S. Cl. ..... 222/135; 141/103; 141/104; 141/147; 222/144; 222/144.5; 222/168.5; 222/380

[58] Field of Search ..... 222/134, 135, 144, 144.5, 222/168.5, 226, 380; 141/147, 103, 104

[56] References Cited

U.S. PATENT DOCUMENTS

| | | | |
|---|---|---|---|
| 1,782,980 | 11/1930 | Ude . | |
| 2,416,581 | 2/1947 | Harr | 225/26 |
| 3,015,415 | 1/1962 | Marsh et al. | 222/14 |
| 3,023,936 | 3/1962 | Marsh et al. | 222/235 |
| 3,122,272 | 2/1964 | Marsh | 222/135 X |
| 3,168,123 | 2/1965 | Pellerino et al. | 141/147 |
| 3,335,767 | 8/1967 | Manas | 141/147 |
| 3,540,631 | 11/1970 | Schmidt | 222/181 |
| 3,565,132 | 2/1971 | LeFort | 141/147 |
| 3,587,671 | 6/1971 | Gamberini | 141/147 X |
| 3,777,950 | 12/1973 | Kiddon | 222/554 |
| 4,027,785 | 6/1977 | Edstrom et al. | 222/135 |
| 4,258,759 | 3/1981 | Achen | 222/144 X |
| 4,394,944 | 7/1983 | Rech | 222/553 |
| 4,635,688 | 1/1987 | Graffin | 141/147 X |
| 4,967,938 | 11/1990 | Hellenberg | 222/144 |
| 5,078,302 | 1/1992 | Hellenberg | 222/144 |

*Primary Examiner*—Andres Kashnikow
*Assistant Examiner*—Joseph A. Kaufman
*Attorney, Agent, or Firm*—Fitch, Even, Tabin & Flannery

[57] ABSTRACT

A sealing valve arrangement for dispensing apparatus having a turntable rotatably mounted on a support includes a valve with an outwardly protruding operator member with a free end remote from the valve, and a valve mount for mounting the valve to the turntable mount for travel with the turntable. A cam block mounted stationary on the turntable support defines a channel for receiving the free end of the operator member and, with rotation of the turntable, moves the operator member so that the valves move from one position to another.

20 Claims, 6 Drawing Sheets

158
160
110
184
168
172
166
174
186

162
184
172
180
176
170
174
186

160
162
170
172
184

108

DISPENSING APPARATUS HAVING IMPROVED VALVING

BACKGROUND OF THE INVENTION

1. Field of the Invention

The present invention pertains to dispensing apparatus for liquid and pulverulent materials, and more particularly to such apparatus which is suitable for a manual or only partially automated dispensing operation. The present invention also pertains to valve sealing or closing apparatus.

2. Description of the Related Art

Many commercially important materials in use today are dispensed in accurate portions accordingly to carefully controlled formulations. Such materials include liquid materials such as food flavorings and chemical additives as well as pulverulent materials such as paints, paint colorants, and inks, for example.

Commercial opportunities have arisen for small quantity, often one-of-a-kind formulation, as well as mass-produced formulations. The assignee of the present invention has provided a number of important advances to promote the art of dispensing relatively small quantities of materials in an accurate, but yet repeatable manner. As with other commercial enterprises, dispensing apparatus must be quickly and easily adaptable to change, especially changes in materials being dispensed, and specific formulations for those materials. As will be discussed further herein, a change common to many types of commercially important materials is that the materials are faster drying, and to be commercially successful, dispensing apparatus must be able to accommodate such fast drying materials.

Broadly speaking, dispensing apparatus used in the food, printing and paint industries, as well as other industries, may be broadly classified as offering either manual or (fully) automatic operation, as well hybrid apparatus performing semi-automatic operation. Examples of manual dispensing apparatus include those disclosed in U.S. Pat. Nos. 4,813,785 and 4,953,985, assigned to the assignee of the present invention. This manual dispensing apparatus has met with immediate commercial acceptance and is valued for its simple operation and low cost of acquisition and maintenance. This dispensing apparatus employs manually operated dispensing pumps of the type disclosed in U.S. Pat. No. 4,027,785, also assigned to the assignee of the present invention.

Depending upon the application, if only a small number of different materials are required, the dispensing pumps and their associated storage canisters may be mounted in a stationary form, with a receptacle for receiving one or more of the materials being passed from one dispensing pump to another. However, when relatively large numbers of different materials are needed for a formulation, the canisters and dispensing pumps are often mounted on a turntable and the receptacle is held stationary while the turntable is rotated to bring a desired material into a dispensing position. For example, to reduce inventory, paint retailers have opted to tint a common paint base with the necessary colorants and additives to provide a desired formulation, on an as-needed demand basis. It is not uncommon for such installations to have a relatively large number of colorants, for example 16 different colorants, for a particular paint "system." The 16 canisters are mounted at the outer periphery of a turntable which is rotated to bring a particular canister into position, with the turntable thereafter being locked in position, while the manual pump dispensers are operated.

U.S. Pat. No. 4,027,785 discloses a so-called dual pump dispenser having a relatively large capacity pump and also a relatively small capacity pump for each colorant, so as to improve dispensing accuracy and speed of delivery. Typically, a partial stroke of the larger size pump may deliver an amount of material equal to several full stroke operations of the smaller size pump.

In each of the above-mentioned dispensing apparatus, a dispensing valve is manually operated which opens a fluid communication path between the pump dispensers and the receptacle to receive the metered material. After dispensing operation, the valve is manually closed to provide a positive closure for the dispensing system, preventing an inadvertent escape of material. Sometimes, the manually operated valve is spring biased to a closed position, requiring an operator to hold the valve open during a pumping operation. Typically, the operator places one hand on the manual valve, and operates the dispensing pumps with the other hand. Depending upon the stroke of the pumps, the condition of their maintenance, nozzle size and viscosity of materials being dispensed, as well as other factors, it may be awkward for an operator to develop the necessary pumping force. Advantages could be attained if the valves were opened and closed at the proper time, without requiring operator intervention.

Also, although a great number of manual pump dispensers have been successful in providing continuous reliable operation over many years, materials having unforeseen rapid drying times are now beginning to be employed and modifications to existing equipment to address these issues are being sought.

In addition to manual dispensing apparatus, the assignee of the present invention has developed (fully) automatic dispensing apparatus, which has also met with ready commercial acceptance. Examples of such apparatus are disclosed in commonly assigned U.S. Pat. Nos. 4,967,938 and 5,078,302. Typically, such apparatus is employed by large volume mass producers of paint, ink and food flavoring materials for example. In this type of apparatus, formulations are stored in a digital computer. Valve operating and pump operating equipment is provided at a dispensing station, located at a point adjacent the turntable, and is coupled to the computer so as to be controlled thereby. An operator selects a particular formula, by name, from a list of formulas stored in the computer. When the formulation is identified, the computer rotates the turntable so as to bring a first material called for by the formula to the dispensing station. The computer then directs the valve operator to open the valve and to prepare the pump operator for a pumping stroke. Under computer control, the pump is operated so as to discharge an amount called for by the selected formula. After the pumping operation is completed, the computer calls for closing of the valve, and the turntable is indexed so as to present the next material called for by the formulation, to the dispensing station, with the dispensing cycle being repeated as many times as necessary. U.S. Pat. No. 5,119,973, also assigned to the assignee of the present invention, discloses what may be termed a "semi-automatic" dispensing apparatus, which is similar to the fully automatic apparatus described above, except that the operator is required to manually index the turntable. As with the fully automatic apparatus, the valve operation and pump operation is under computer control.

As mentioned, the manual dispensing apparatus is attractive to many users because of its low acquisition cost. Modifications to the equipment using computer or analog circuit control of a solenoid actuator or other valve operator would be too costly for this type of product. Accordingly, improvements to this type of dispensing apparatus are still being sought.

The aforementioned U.S. Pat. No. 5,078,302 discloses a sealing valve adapted for retrofit assembly with a fully automatic dispensing apparatus. The sealing valve is spring biased to a closed position, and is held open during a dispensing operation by mechanical linkage attached to the valve operator, which, as mentioned, is under computer control.

SUMMARY OF THE INVENTION

It is an object of the present invention to provide additional sealing for dispensing valves which are manually operated.

Another object according to principles of the present invention is to provide sealing apparatus which does not require operator intervention during a dispensing cycle.

A further object according to principles of the present invention is to provide valve sealing apparatus which does not require solenoids, pneumatic pistons or the like control devices for its operation.

Yet another object according to principles of the present invention is to provide valve sealing apparatus of the above-described type which may be readily retrofitted to existing apparatus and which may also be readily incorporated into current designs.

These and other objects of the present invention which will become apparent from studying the appended description and drawings are provided in a valve mechanism for mounting to a turntable which is rotatably supported on a turntable support, comprising:

a valve assembly having a valve body, a valve member movably mounted within the valve body and an operator member coupled to the valve member, the operator member having a free end protruding outside the valve body and movable between first and second positions to operate the valve member between closed and open positions, respectively;

mounting means for mounting the valve assembly to the turntable for travel therewith so as to move the operator free end along a preselected path of travel;

a cam block mounted to the turntable support adjacent a point on the path of travel; and said cam block defining a channel having a first channel portion extending generally along the path of travel and a second channel portion extending from the first channel portion, away from the path of travel so as to displace the operator free end as the turntable is rotated, to thereby move the valve member between said closed and said open positions.

BRIEF DESCRIPTION OF THE DRAWINGS

FIGS. 11–16 show a sequence of operation of the valve mechanism wherein FIGS. 11, 13, and 15 show a sequence of operation of the valve mechanism in front elevation, and wherein FIGS. 12, 14 and 16 are fragmentary cross-sectional views of FIGS. 11, 13 and 15, respectively;.

DETAILED DESCRIPTION OF THE PREFERRED EMBODIMENT

Figure 1:
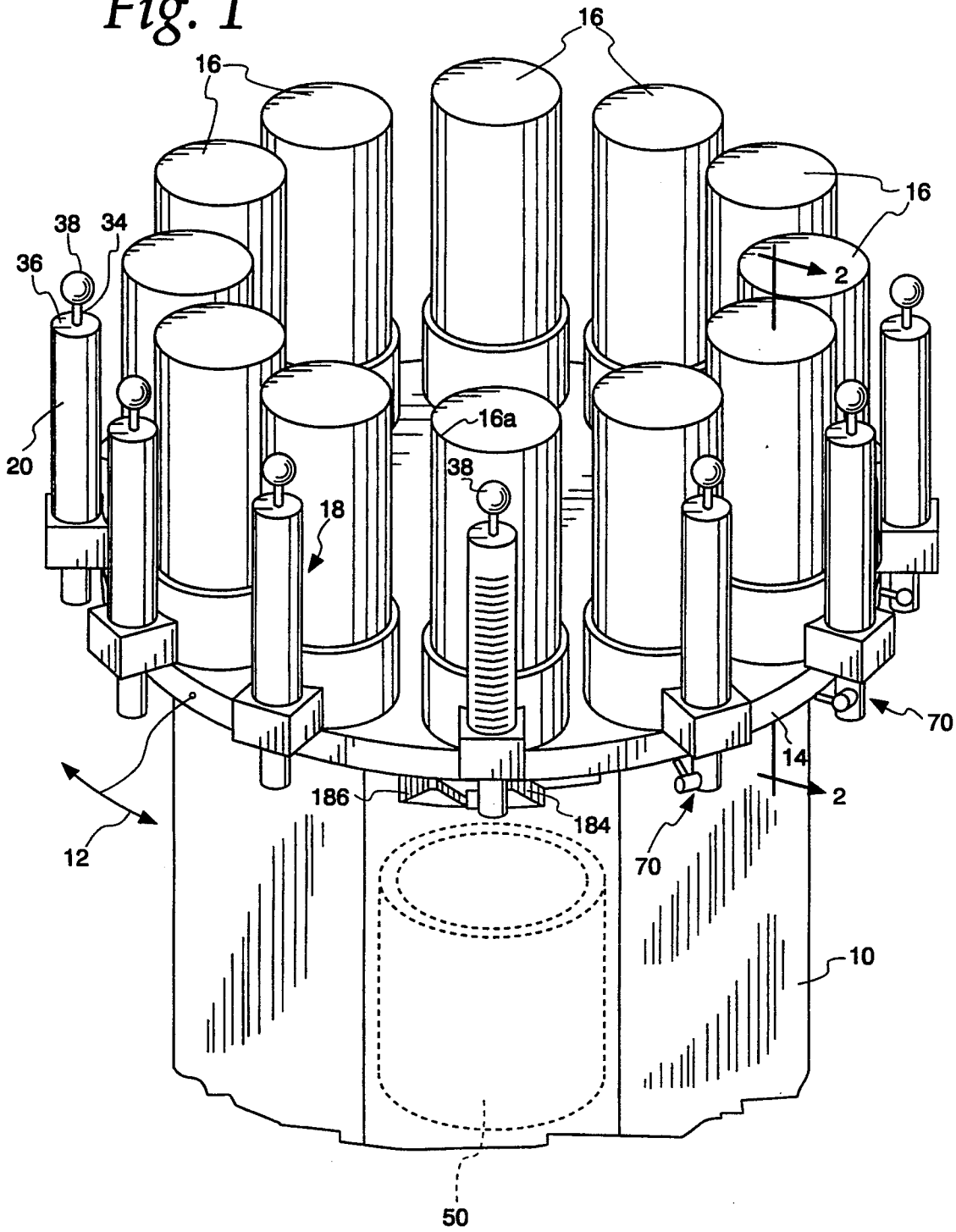
FIG. 1 is a perspective view of dispensing apparatus according to principles of the present invention.

Referring now to the drawings, and initially to FIG. 1, the dispensing apparatus according to the present invention comprises a cylindrical base 10 which supports a turntable 14 for rotation in the direction of arrow 12. Turntable 14 carries a plurality of separate, cylindrically-shaped material canisters or containers 16 which are preferably identical in construction. In the embodiment illustrated in FIG. 1, twelve containers are shown, although the number of containers on turntable 14 can be increased or decreased, as desired. Each container 16 has a supply of material to be dispensed, e.g., a liquid paint coloring, and each container 16 includes a hand-operated pump mechanism generally indicated at 18 for dispensing a metered quantity of material from its associated container 16. Single pump mechanisms are shown in the embodiment of FIG. 1, although dual pump mechanisms, such as those described in U.S. Pat. No. 4,027,785 (the disclosure of which is herein incorporated by reference as if fully set forth herein), can also be used.

Figure 2:
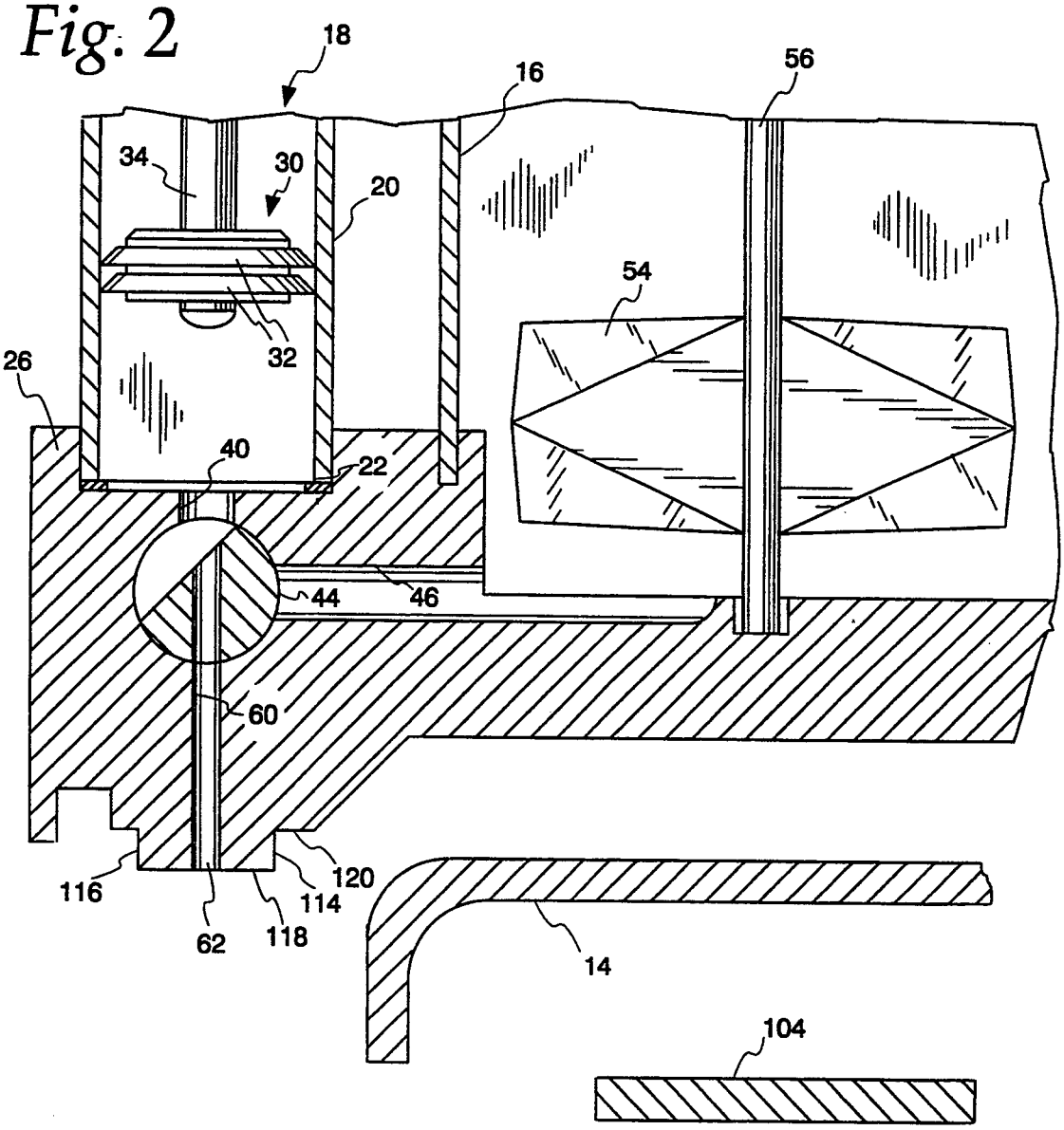
FIG. 2 is a fragmentary cross-sectional view taken along the line 2—2 of FIG. 1.

With reference to FIG. 2, the pump mechanism 18 includes a pump cylinder 20, the lower end 22 of which is mounted on a monolithic mounting block 26. A piston 30, which includes a plurality of seals 32, is carried at the lower end of a piston rod 34, which, as can be seen in FIG. 1, extends through the upper closed end 36 of cylinder 20. A knob 38 is mounted at the free end of piston rod 34, and by grasping rod 38, an operator can apply a reciprocating motion to the piston rod, thus effecting a pumping stroke.

With reference again to FIG. 2, a passageway 40 is formed in mounting block 26, beneath cylinder 20. Passageway 40 receives material under pressure during a compression stroke of piston 30. The pressurized material is controlled by a first or upstream valve member 44 which is movable to multiple positions and is of the same general configuration and operation as the valve member disclosed in the aforementioned U.S. Pat. No. 4,027,785. For example, valve member 44 controls the flow of material in container 16 traveling through passageway 46, which preferably extends in a generally radial direction through mounting block 26.

The apparatus according to the present invention can be adapted to dispense a wide variety of liquid and pulverulent materials, and has found ready acceptance in the paint industry. In the preferred embodiment, container 16 holds a colorant material which is selectively dispensed in a paint can holding a paint base material, as indicated in phantom in FIG. 1. In that Figure, a paint can 50 is mounted beneath turntable 14, and with appropriate rotation of table 14 in the direction of double-headed arrow 12, a particular container can be located above can 50. The foremost container 16a, shown in FIG. 1, is positioned at a dispensing station, located above the stationary paint can 50. By operating the knob 38, a preselected, metered quantity of colorant is dispensed into paint can 50. The turntable 14 is thereafter rotated in a desired direction until a subsequent container is located at dispensing station, above paint can 50, and a further dispensing operation is carried out.

As those familiar with the are aware, paint colorants (as well as other materials) are often comprised of multiple components suspended in a liquid medium. The heavier components, often times particulates and denser liquids, tend to settle over time at the bottom of the container 16. Accordingly, it is generally preferred that a mixing blade 54 be provided at the bottom of the containers, and that the blade be rotatably driven by a mixing shaft 56. A system for driving shaft 56 is not shown in the drawings, but could, for example, comprise the drive system shown in U.S. Pat. No. 4,953,985, assigned to the Assignee of the present invention. Material is drawn into cylinder 20 on an upward or intake stroke of piston 30, through passageways 46 and 40 into pump mechanism 18. Upon rotation of valve element 44, passageway 40 is brought into communication with a lower passageway 60, having an outlet 62 through which metered material is dispensed in a downward direction. In FIG. 2, a downstream sealing valve mechanism has been omitted for purposes of clarity.

Figure 3:
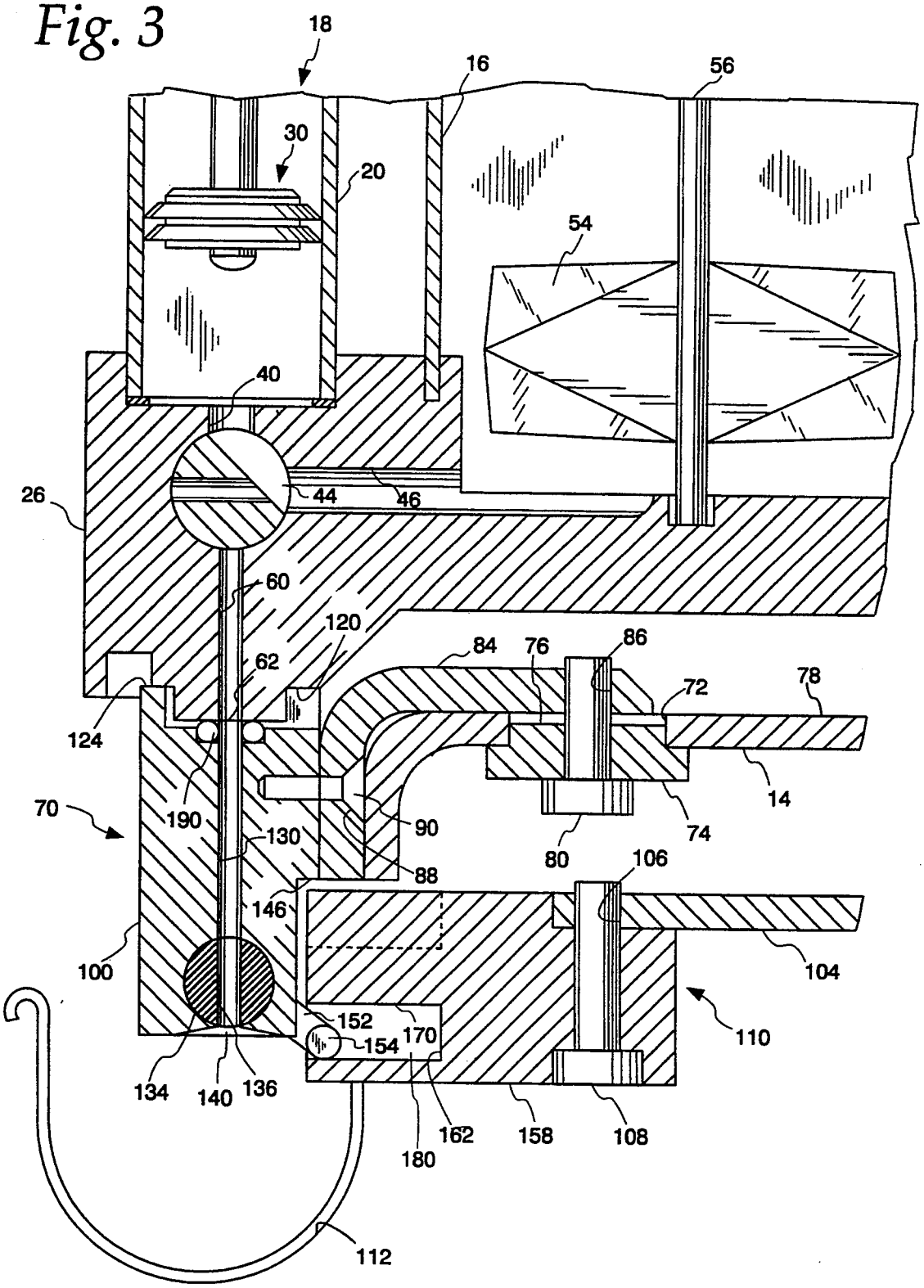
FIG. 3 is a fragmentary cross-sectional view similar to that of FIG. 2, but showing the addition of a valve mechanism.
Figure 4:
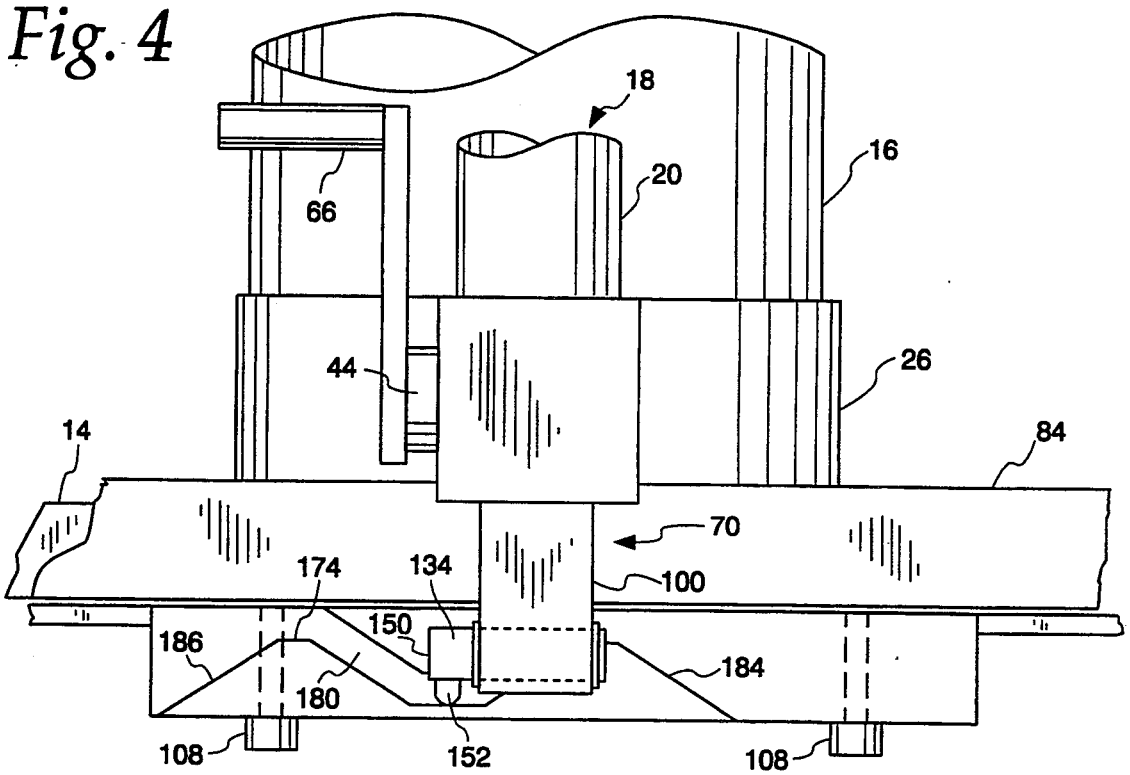
FIG. 4 is a fragmentary front elevational view of one of the containers shown in FIG. 1.

Referring briefly to FIG. 4, valve member 44 is moved between operating positions by a manually engageable crank handle 66, which is raised and lowered as required during a dispensing operation. As can be seen in FIG. 2, the length of passageway 60 is quite long relative to its cross-sectional dimension. Material left in passageway 60 after a dispensing operation is open to the atmosphere. It has been observed that increasing numbers of materials have recently been made to have increased volatility, and thus it has become increasingly important to protect the material passageways and to improve dispensing with these newly formulated materials. Accordingly, with reference to FIGS. 1 and 3 a sealing valve assembly, generally indicated at 70, is provided to seal the passageway 60 from the atmosphere. As will be seen herein, the sealing valve assembly is quickly and easily installed on the dispenser arrangement shown in FIG. 2.

The turntable 14 shown in FIG. 3 has an aperture 72 formed therein for receiving a plug fitting 74 having a central aperture and a stepped outer periphery to maintain the upper face 76 thereof recessed with respect to the upper surface 78 of turntable 14. A threaded fastener schematically indicated at 80 secures the plug fitting 76 to turntable 14 by engaging a mounting means or bracket 84 which is generally L-shaped in cross section and which has a threaded aperture 86 for receiving the threaded end of fastener 80. A second aperture 88 receives a flat head screw 90 for mounting a valve body or housing 100 to bracket 84 and ultimately to turntable 14, for movement therewith.

Also shown in FIG. 3 is a turntable support or support disk 104 secured to base 10 and being stationary or fixed in position with respect to the dispensing apparatus. The support plate 104 defines a threaded aperture 106 for receiving a threaded fastener 108. Fastener 108 secures a cam plate 110 secured by fastener 108 to support plate 104. A leakage gully or gutter 112 is mounted to turntable 14 for rotation therewith by means not shown in the Figure. The gutter 112 is omitted from the other Figures for purposes of clarity, and serves no part of the present invention.

With reference to FIG. 2, the lower end of mounting block 26, that end adjacent orifice 62, is stepped at 114 with a step of cross-sectional size considerably larger than the cross-sectional size of channel 60. The step 114 includes sidewalls 116 and a horizontal wall 118. The step exposes a horizontal wall 120 in the underside of block 26.

Figure 17:
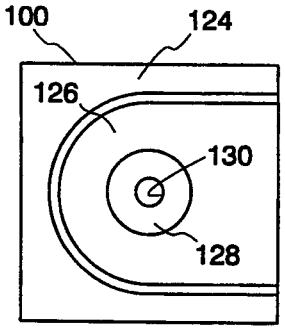
FIG. 17 is a top plan view of a sealing valve member.

Turning now to FIG. 17, the valve housing 100 has an upper surface 124 with a U-shaped recess 126 opening toward the rear of the housing, i.e., toward the center of turntable 14. A circular recess 128 is located within the U-shaped recess 126 and is centered with respect to a passageway 130 which extends throughout the height of housing 100.

Figure 18:
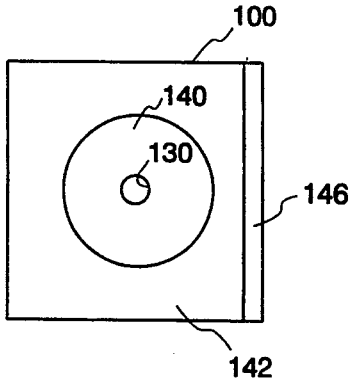
FIG. 18 is a bottom plan view thereof.

A valve member, or sealing valve, 134 is located near the bottom of housing 100 and has a central passageway 136 which communicates with passageway 130 when the sealing valve is in an open position. An exit orifice 140, preferably taking the form of a low profile, large diameter cone, is formed at the bottom of housing 100 and is located at the terminus of material flow through housing 100, with the remainder of the bottom surface 142 of housing 100 having a flat, planar configuration. The orifice 140 is very shallow (and is much shorter than the passageway 60). This discourages accumulations of material on this dispensing equipment, and contributes to a more accurate metering. Further, since the dispensing apparatus is maintained free of material accumulations, dried material will not form which could impair dispensing and require frequent cleaning. A stepped edge 146 can be seen at the right-hand end of FIG. 18. Thus, the upper end of housing 100 is in substantial contact with the bottom surface 120 of mounting block 26, from the front to the back of the housing.

As will now be appreciated, the sealing valve assembly can be quickly and easily mounted on existing equipment having a carousal-type structure or other types of moving structure, such as a reciprocating bed carrying a plurality of canisters. For example, with reference to FIG. 3, the support plate 104 can, with simple screw mountings, conveniently accommodate cam block 110. Simple screw mounting can also be used for the sealing valve and mounting bracket assembly, which presses the upper end of the housing 100 into sealing engagement with the lower end of block 26. A resilient gasket, preferably in the form of an O-ring 190, provides a pressure-tight seal between the relatively massive block 26 and housing 100.

Figure 6:
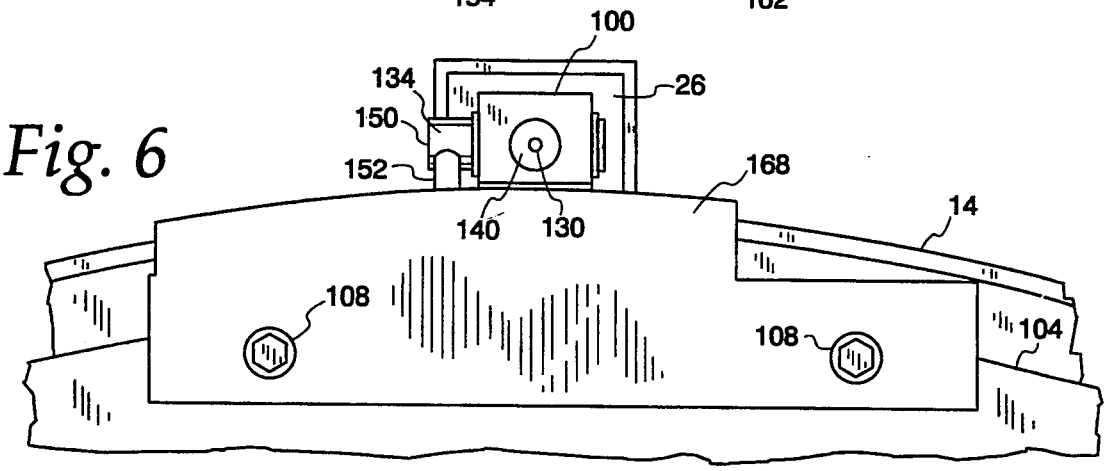
FIG. 6 is a bottom plan view thereof.

Referring now to FIGS. 3, 4 and 6, sealing valve 134 extends through housing 100 and has an exposed free end 150 located to one side of housing 100. An actuator arm 152 having a rounded free end 154 (see FIG. 3) is secured to valve element 134 and is thereby mounted for rotation about the central axis of the valve element. The free end 154 preferably comprises a roller. Thus, with reference to FIG. 3, for example, valve 134 is moved between closed and open positions as the actuator arm is moved up and down, i.e., is rotated about the central axis of the valve element 134. In the preferred embodiment, there is no mechanical interaction provided between the sealing valve assembly and the main or upstream valve member 44 (as is found in commercially successful automatic dispensing equipment available today, an example of which is given in commonly assigned U.S. Pat. No. 5,119,973). Rather, as will now be seen, actuation of sealing valve 134 is provided by contact with a stationary cam member supported (ultimately) by base 10. The cam member 110 and mounting to a support plate 104 was described above with reference to FIG. 3, and features of the cam block will now be described in greater detail With reference to FIGS. 7–10, the cam block 110 includes a mounting portion 158 which defines mounting holes 160 for receiving the threaded fasteners 108, as was described above with reference to FIG. 3. The mounting portion 158 is generally of rectangular plinth-like configuration, i.e., a six-sided rectangular solid having a front face 162 (visible in the front elevational view of FIG. 8). Camming elements extend from the front face 162 and, as will be seen herein, guide the free end 154 of actuator arm 152 in an up-and-down direction so as to operate sealing valve 134 without requiring operator attention to the sealing valve operation.

In the preferred embodiment, the camming elements are provided as two outward protrusions, an upper protrusion 166 and a lower protrusion 168. It is generally preferred that the upper protrusion 166 have a single camming lobe 170 while the lower protrusion 168 has two lobes, 172, 174, with a depression 176 therebetween located opposite and complementing the protrusion 170. Together, the upper and lower cam elements form a passageway or channel 180 of generally constant cross-sectional dimensions throughout its length.

According to other aspects of the preferred embodiment, the camming elements are formed so as to include initial camming surfaces 184, 186 of extended length so as to guide the actuating arm of the sealing valve into channel 180 with a minimum disturbance of the sealing valve assembly.

Figures 7, 8, 9, 10:
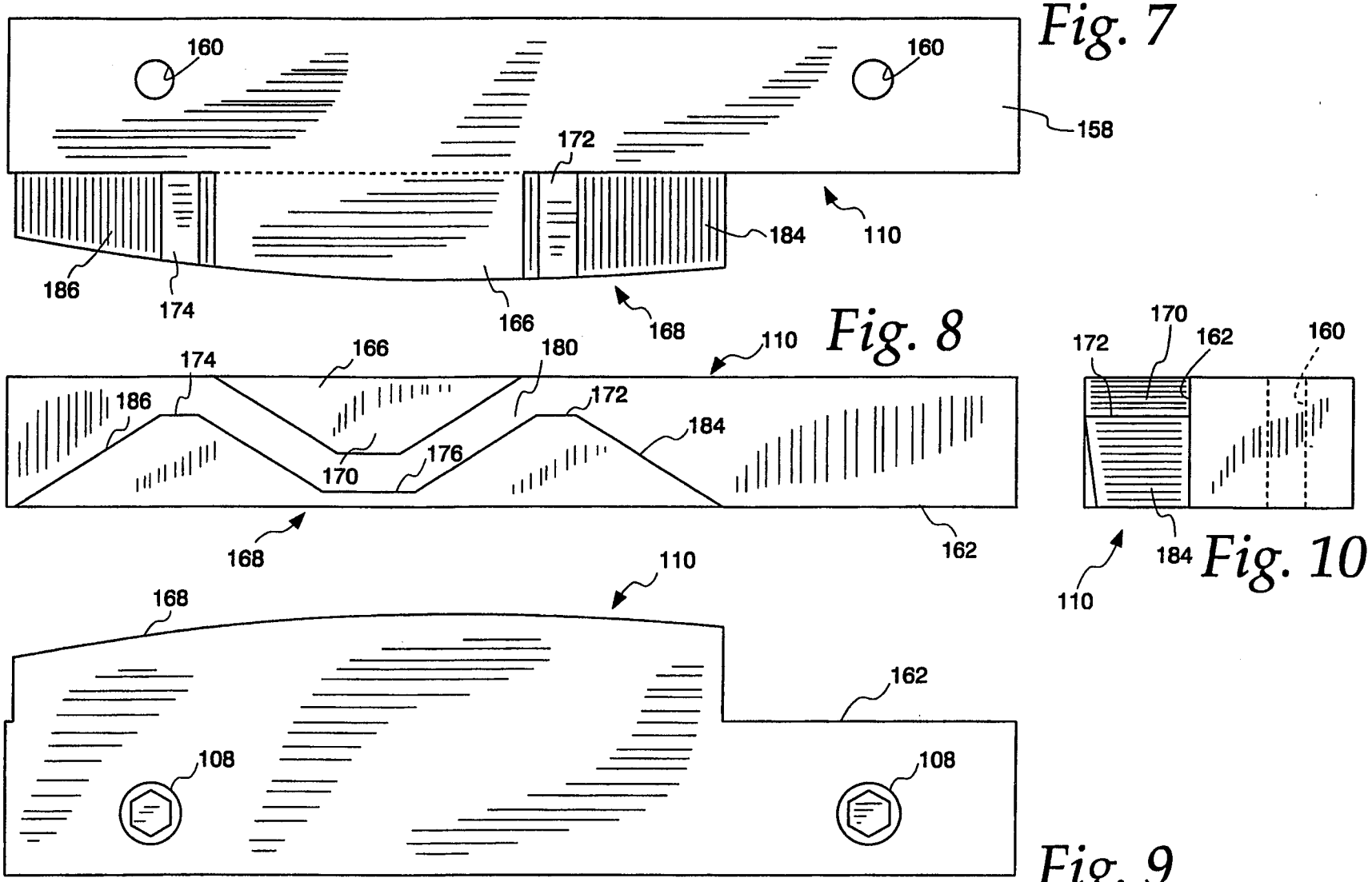
FIG. 7 is a top plan view of the cam block shown in FIG. 6.
FIG. 8 is a front elevational view thereof.
FIG. 9 is a bottom plan view thereof.
FIG. 10 is an end elevational view thereof.

As can be seen in FIG. 8, the camming portions 166, 168 are preferably configured so that the entrance ramps 184,186, and at least part of the lobes 172, 174, are upwardly exposed, as can be seen, for example, in FIG. 7. This allows for ready visual inspection of the surfaces for wear and for easy cleaning and maintenance.

As can be seen in FIG. 8 (and also in FIGS. 4 and 5, for example) the lobes 170, 174 and 172 are preferably not rounded, but rather have "flats" or generally planar surfaces. The angled, intermediate camming surfaces on either side of the lobes are preferably flat, planar surfaces, and in the preferred embodiment are angled at approximately 45°. If desired, however, the lobes could be rounded. The "corners" formed in the upper and lower camming members 166, 168 could also be rounded, and if desired, the camming surfaces between lobes could be curved rather than planar. However, the configuration illustration in the drawings is generally preferred for economy of fabrication and for desired operation of the sealing valve. The cam plate 110 is preferably made of DELRIN, TEFLON, or other suitable material, preferably a plastic material.

Figure 5:
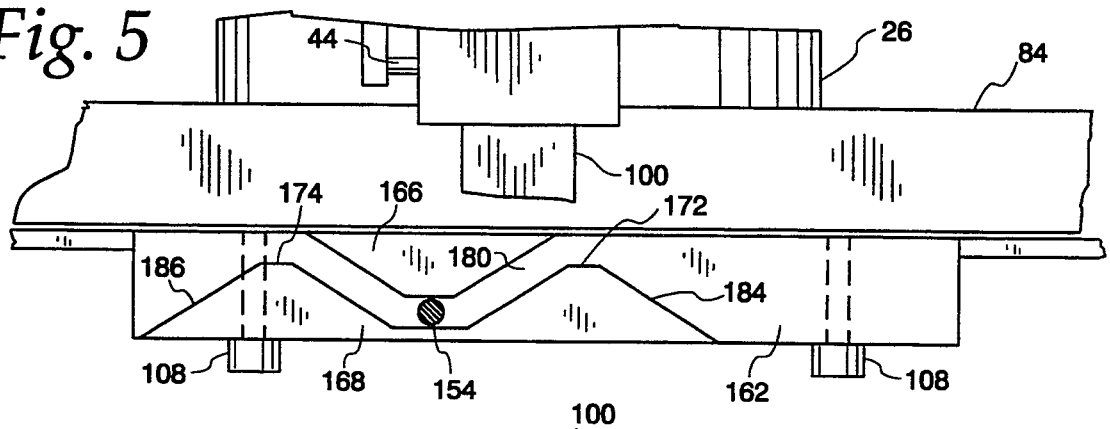
FIG. 5 is a fragmentary front elevational view similar to that of FIG. 4, but showing a portion of the valve mechanism removed.

Turning now to FIG. 5, the free end of the sealing valve actuator arm is disposed in channel 180. As can be seen in FIG. 12, the free end 154 is located between the camming elements 166, 168 being held captive in channel 180. In the position shown in FIGS. 4, 5, 11 and 12, the sealing valve 134 is in an open position and material under pressure of piston 130 is dispensed into container 50.

Figure 11:
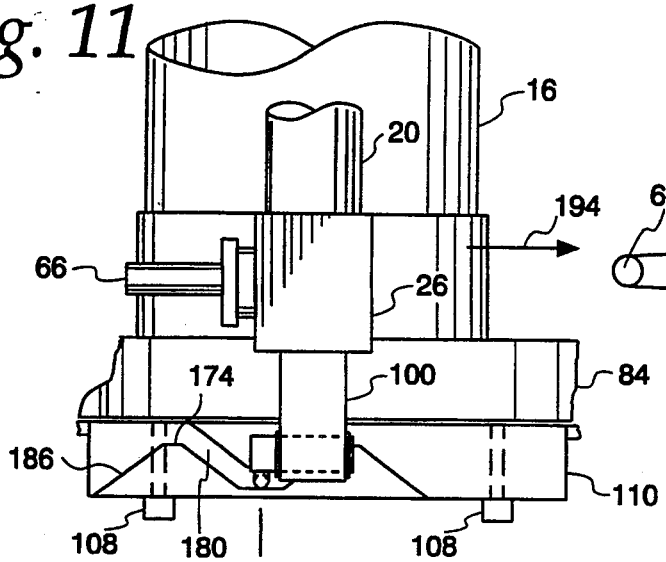
Figure 12:
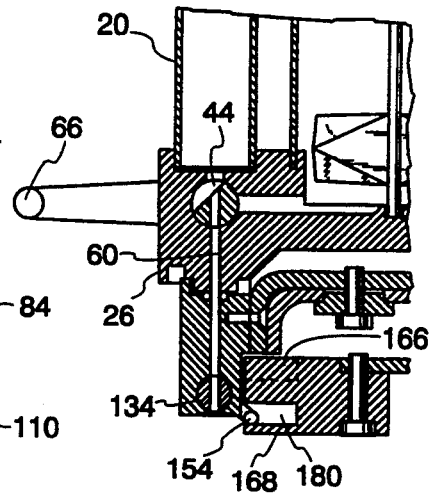

The crank handle 66, shown in FIG. 11, is in a lowered position which "opens" the upstream valve 44 for dispensing material through the channel 160 formed in block 26. Immediately after a downward stroke of piston 30, the crank handle 66 is raised to the vertical position shown in FIG. 13 in an operation independent from that of the sealing valve. When in the vertical position, the crank handle 66 moves the valve 44 to the position shown in FIG. 14, ready for a suction or upward stroke of the piston 30 to fill the cylinder 20 with material, in anticipation of a subsequent discharge. In practice, the piston 30 is left in a downward position, completely evacuating cylinder 20. It is only upon a subsequent formulation performed, presumably upon a different can of paint base material, that the piston 30 will be raised so as to fill cylinder 20 with a metered quantity of colorant material.

FIGS. 11–16 show a sequence of operation following a dispensing operation in which the sealing valve is closed. As mentioned, in FIGS. 11 and 12, the sealing valve is open for a dispensing operation. The free end of the actuating lever is moved to a lower position at a lower portion of channel 180.

Figure 13:
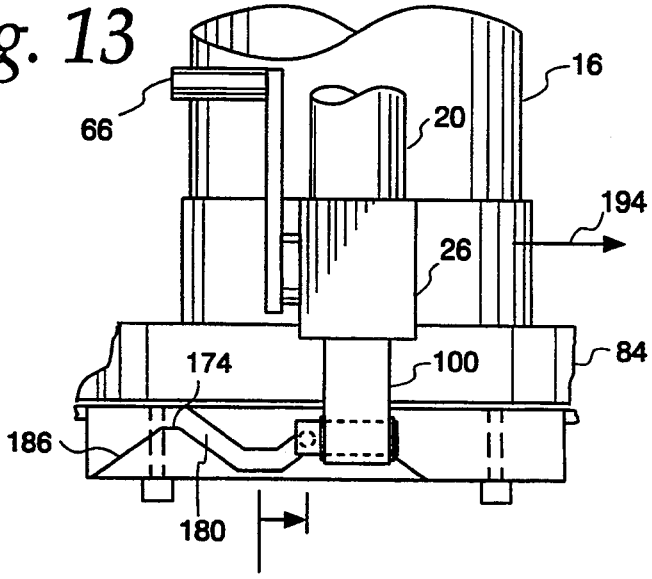
Figure 14:
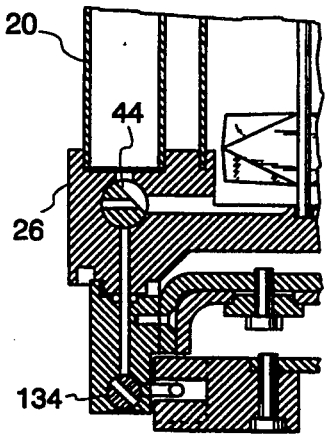
Figure 15:
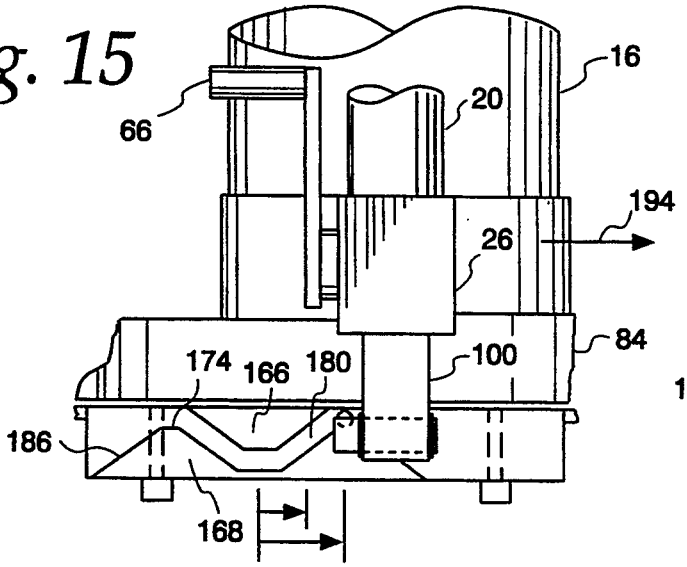
Figure 16:
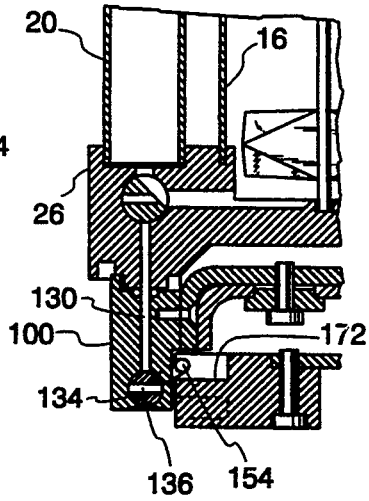

In the preferred embodiment, the turntable 14 can be rotated in either direction of arrow 12; and in FIGS. 13–16, the turntable is moved in a rightward direction, as indicated by the arrow 194. As the turntable is rotated to the right, the free end 154 of the actuating arm is also moved to the right and is made to traverse the upwardly inclined, intermediate portion of channel 180, as indicated in FIG. 13. As can be seen in FIG. 14, the sealing valve 134 has been moved so as to close off the bottom end of the dispensing path. As will be appreciated by studying FIGS. 12 and 14, valve 134 is actually closed before reaching the point illustrated in FIG. 13, almost upon immediately leaving the lowermost dispensing position illustrated in FIG. 11. In FIG. 13, the free end 154 is located approximately one-half of the horizontal or lateral distance between the vertically offset channel portions 176, 172, shown, for example, in FIG. 8

Rotation of the turntable continues in the direction of arrow 194, bringing the free end 154 of the actuating lever to the upper channel portion, containing protrusion 172. In a position shown in FIG. 16, the valve channel 136 is preferably oriented at generally right angles to the channel 130 formed in housing 100. Thus, after a complete rotation of turntable 14, the free ends 154 of the actuating levers are moved to upward positions, with the sealing valves in a fully-closed configuration.

Assuming that a rightward rotation of turntable 14 is continued, the free end 154 of the sealing valve actuating lever approaches the left-hated end of the camming plate in anticipation of a dispensing operation. The free end 154 enters channel 180 as it passes over the lobe 174. The free end 154 then contacts the left-hand, intermediate, inclined surface of the upper camming member 156. The free end 154 of the actuating lever is then guided along channel 180 in a downward sloping direction, which, with gradual movement of the sealing valve 134, opens the sealing valve to the position indicated in FIG. 12. As will be appreciated, although the movement of the actuating arm 152 is gradual, the actual opening time for performing a discharge passageway is relatively quick.

In the preferred embodiment, there is no provision for locking the actuator arm, of a sealing valve assembly in a given position when the containers 16 are located away from the dispensing station. Accordingly, it is possible that an actuating arm of a sealing valve assembly may become inadvertently dislodged in an opened, or at least a downwardly, deflected position. If the turntable is moved in a right-hand direction, the free end 154 would contact the inclined surface 186, moving the free end to the lobe 174, fully closing the valve, before moving the free end to the depression 176 whereat the sealing valve is fully opened.

As will now be seen, the sealing valve arrangement of the present invention causes the sealing valve to undergo a complete cycle of movement every time a canister is presented to the dispensing station, thus ensuring that operation of the dispenser will not be impaired, due to hardening of the material dispensed. When the dispensing apparatus is not in use, the turntable is moved to a "docking position" so that containers are not located at the dispensing station, and so that the sealing valves of all containers on the turntable are in a fully closed position.

Thus, as can be seen from the above, separate, independent operation of a sealing valve is provided for each container of the dispensing apparatus, which offers particular advantages for difficult materials, such as materials which quickly evaporate when exposed to the atmosphere. Further, the present invention provides sealing valves which are fully operable without requiring operator attention, and accordingly, an operator need not be concerned with details of the sealing valve operation. Further, the components of the sealing valve assemblies require little or no maintenance. Also, sealing valve assemblies, according to principles of the present invention, can be fabricated and installed on existing systems with a minimal cost investment.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A sealing valve mechanism for mounting to an exit opening of a discharge valve carried on a turntable which is rotatably supported on a turntable support, comprising:

a valve assembly having a valve body, a valve member movably mounted within the valve body and an operator member coupled to the valve member, the operator member having a free end protruding outside the valve body and movable between first and second positions to operate the valve member between closed and open positions, respectively;

mounting means for sealingly mounting the valve assembly in sealing engagement with portions of the discharge valve adjacent its exit opening so as to be carried on the turntable for travel therewith so as to move the operator free end along a preselected path of travel;

a cam block mounted to the turntable support adjacent a point on the path of travel; and said cam block defining a channel having a first channel portion extending generally along the path of travel and a second channel portion extending from the first channel portion, away from the path of travel so as to displace the operator free end as the turntable is rotated, to thereby move the valve member between said closed and said open positions and to open the valve member in preparation for dispensing a material from said discharge valve.

2. The valve mechanism of claim 1 wherein said operator member is elongated, extending in a substantially horizontal direction.

3. The valve mechanism of claim 1 wherein the channel includes first and second channel portions which are vertically offset from one another.

4. The valve mechanism of claim 3 wherein the first and second channel portions are generally linear.

5. The valve mechanism of claim 4 wherein the first and second channel portions are coupled together by at least one intermediate channel portion which is also generally linear.

6. The valve mechanism of claim 1 wherein the valve member is spring biased toward one of said closed and said open positions.

7. The valve mechanism of claim 1 wherein the cam block is formed from a unitary monolithic body.

8. The valve mechanism of claim 1 wherein the free end of said operator member is a roller of generally right circular cylindrical configuration.

9. The valve mechanism of claim 1 wherein the cam block comprises a mounting member having a body with an exposed face, and first and second channel-forming members outwardly protruding from the exposed face and disposed one above the other, said first and second channel-forming members spaced from one another and cooperating with the exposed face so as to form the channel.

10. The valve mechanism of claim 9 wherein one of the channel-forming members includes a pair of spaced-apart lobes and the other channel-forming member includes a single lobe disposed thereabove, so that the lobes lie at the points of a triangle disposed parallel to the exposed face.

11. The valve mechanism of claim 10 wherein the lobes are of generally trapezoidal shape.

12. Dispenser apparatus, comprising:

a turntable rotatably supported on a turntable support;

a dispensing valve carried on the turntable and having an exit opening through which material is dispensed;

a dispensing station adjacent the turntable at which material is dispensed;

a valve assembly having a valve body, a valve member movably mounted within the valve body and an operator member coupled to the valve member, the operator member having a free end protruding outside the valve body and movable between first and second positions to operate the valve member between closed and open positions, respectively;

mounting means for sealingly mounting the valve assembly to the exit opening of the dispensing valve in sealing engagement therewith so as to be carried on the turntable for travel therewith so as to move the operator free end along a preselected path of travel;

a cam block mounted to the turntable support adjacent a point on the path of travel; and said cam block defining a channel having a first channel portion extending generally along the path of travel and a second channel portion extending therefrom, away from the path of travel so as to displace the operator free end as the turntable is rotated, to thereby move the valve member between said closed and said open positions.

13. The valve mechanism of claim 12 wherein said operator member is elongated, extending in a substantially horizontal direction.

14. The valve mechanism of claim 12 wherein the first and second channel portions are vertically offset from one another.

15. The valve mechanism of claim 14 wherein the first and second channel portions are generally linear.

16. The valve mechanism of claim 15 wherein the first and second channel portions are coupled together by at least one intermediate channel portion which is also generally linear.

17. The valve mechanism of claim 12 wherein the valve member is spring biased toward one of said closed and said open positions.

18. The valve mechanism of claim 12 wherein the cam block is formed from a unitary monolithic body.

19. The valve mechanism of claim 12 wherein the cam block comprises a mounting member having an exposed face, and first and second channel-forming members outwardly protruding from the exposed face and disposed one above the other, said first and second channel-forming members spaced from one another and cooperating with the exposed face so as to form the channel.

20. The valve mechanism of claim 19 wherein one of the channel-forming members includes a pair of spaced-apart lobes of generally trapezoidal shape and the other channel-forming member includes a single lobe disposed thereabove, so that the lobes lie at the points of a triangle disposed parallel to the exposed face.

* * * * *